US005875580A

United States Patent [19]

Hill et al.

[11] Patent Number: 5,875,580

[45] Date of Patent: Mar. 2, 1999

[54] RIFLE REST

[76] Inventors: Marshall T Hill, HC 81, Box 108, Needmore, Pa. 17238; Timothy G Peacemaker, HC 71, Box 96, Capon Bridge, W. Va. 26711

[21] Appl. No.: 976,035

[22] Filed: Nov. 21, 1997

[51] Int. Cl.[6] ..... F41C 27/00

[52] U.S. Cl. ..... 42/94

[58] Field of Search ..... 42/94; 89/37.04

[56] References Cited

U.S. PATENT DOCUMENTS

| | | | |
|---|---|---|---|
| 3,012,350 | 12/1961 | Wold | 42/94 |
| 3,473,673 | 10/1969 | Porter | 211/64 |
| 3,621,597 | 11/1971 | Price | 42/94 |
| 3,935,657 | 2/1976 | Wade | 42/94 |
| 4,790,096 | 12/1988 | Gibson et al. | 42/94 |
| 5,233,779 | 8/1993 | Shaw | 42/94 |
| 5,332,185 | 7/1994 | Walker, III | 248/346 |
| 5,596,830 | 1/1997 | Morgan | 42/94 |

*Primary Examiner*—Charles T. Jordan
*Assistant Examiner*—Meena Chelliah
*Attorney, Agent, or Firm*—Brady, O'Boyle & Gates

[57] ABSTRACT

A rifle rest having a pair of frame members pivotally connected to each other in such a manner to provide a cradle portion movable between an open and closed position, and a pair of feet for supporting the rifle rest on a supporting surface. A foldable sand-filled bag is supported on the cradle portion, so that when the support feet are moved in a direction away from each other, the cradle portion and associated sand bag are moved in a closing direction to thereby grip the stock and barrel of a rifle supported on the sand bag. The support feet are provided with friction surfaces for holding the rifle rest in a supporting surface, and a handle is connected to the cradle portion to facilitate the carrying of the rifle rest.

8 Claims, 3 Drawing Sheets

RIFLE REST

BACKGROUND OF THE INVENTION

In U.S. Pat. No. 5,233,779, there is disclosed a rifle rest wherein a pair of sand-filled canvass bags are stitched together along their center lines to thereby form a pair of upper lobes and a pair of lower lobes hingedly connected along the stitch line. When the lower lobes are moved in a direction away from each other, the upper lobes are simultaneously moved in a direction toward each other to thereby grip the stock and barrel of a rifle to be supported.

While the rifle rest disclosed in the above-noted patent has been satisfactory for its intended purpose of gripping the rifle and reducing the amount of recoil transmitted to the rifle person, the rifle rest's main disadvantage is its weight making it difficult to carry.

After considerable research and experimentation, the rifle rest of the present invention has been devised which maintains the satisfactory features of the rifle rest disclosed in the aforementioned patent while greatly reducing its weight to facilitate the carrying of the rifle rest.

SUMMARY OF THE INVENTION

The rifle rest of the present invention comprises, essentially, a pair of frame members pivotally connected to each other to provide a cradle portion and a pair of support feet. A sand-filled canvass bag, stitched along its center line to form a pair of lobes hingedly connected along the stitch line is supported by the cradle portion. By this construction and arrangement when the support feet are moved in a direction away from each other, the cradle portion and associated sand bag are moved in a closing direction to thereby grip the stock and barrel of a rifle supported on the sand bag. The feet are provided with a friction surface to facilitate holding the rest on a supporting surface such as a table, and the cradle portion is provided with a handle to facilitate carrying the rest. By the construction and arrangement of the rifle rest of the present invention, the weight of the rifle rest is reduced by approximately one-third of the weight of the rifle rest disclosed in the aforementioned patent, thereby enhancing the portability of the rifle rest while not sacrificing the features of gripping the rifle and reducing the amount of transmitted recoil.

DESCRIPTION OF THE PREFERRED EMBODIMENTS

Figure 1:
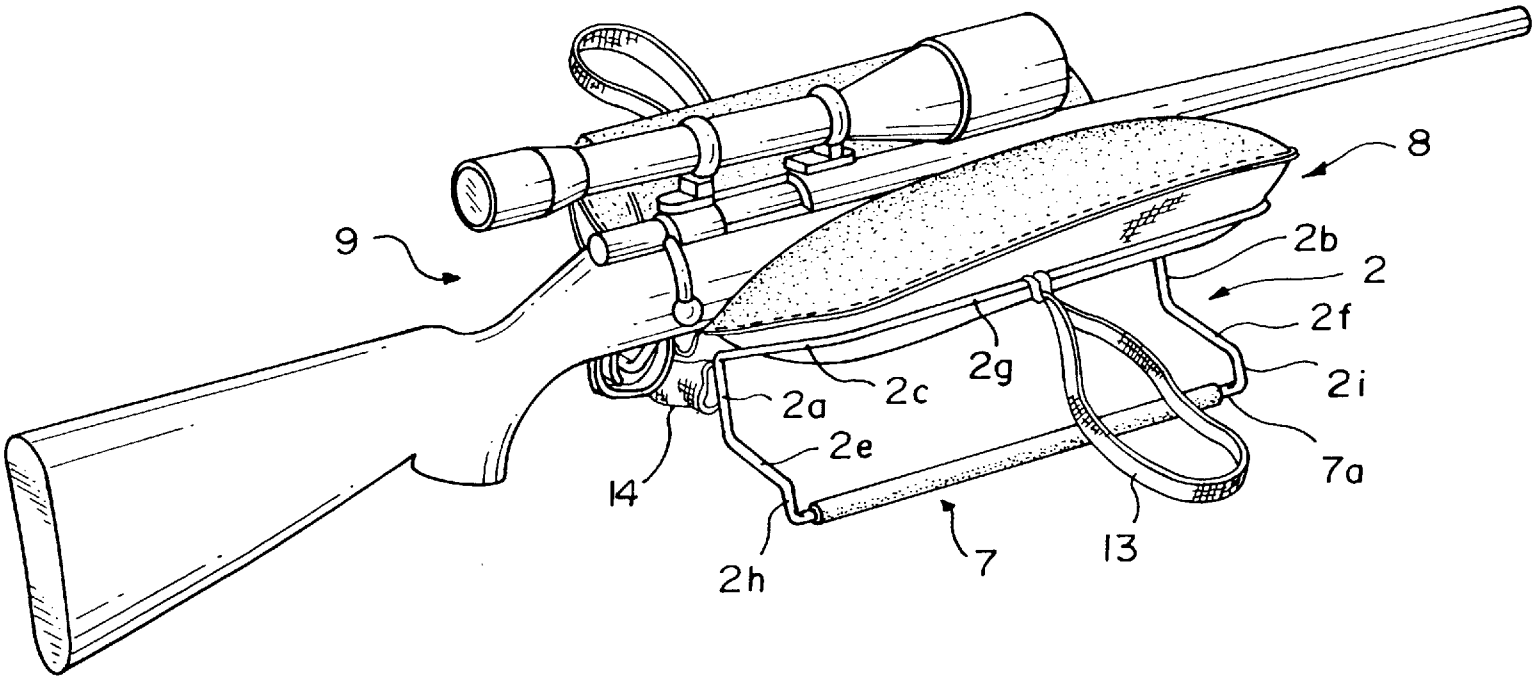
FIG. 1 is a perspective view of the rifle rest of the present invention gripping the stock and barrel of a rifle.
Figure 2:
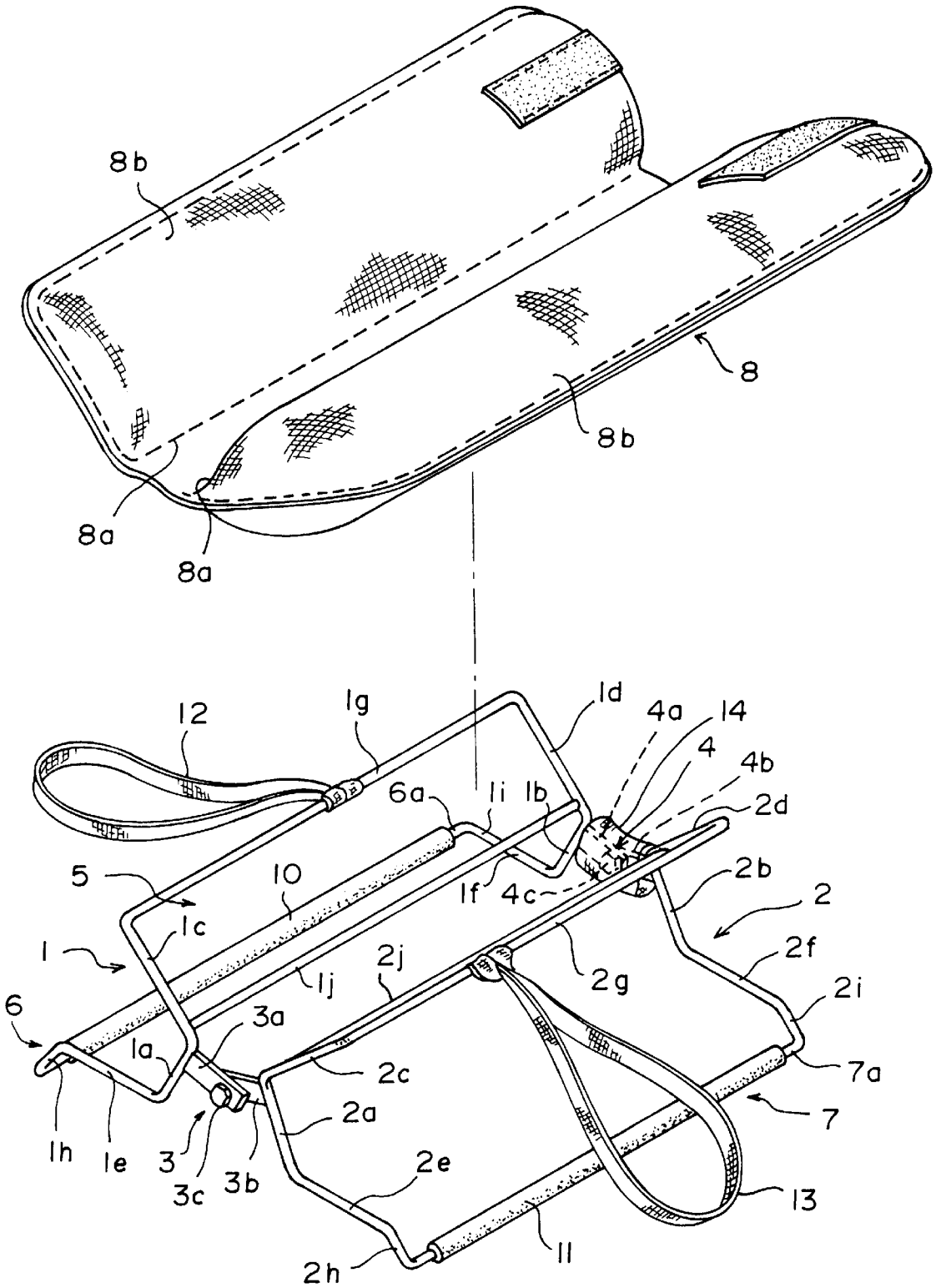
FIG. 2 is an exploded view of the rifle rest shown in FIG. 1.
Figure 3:
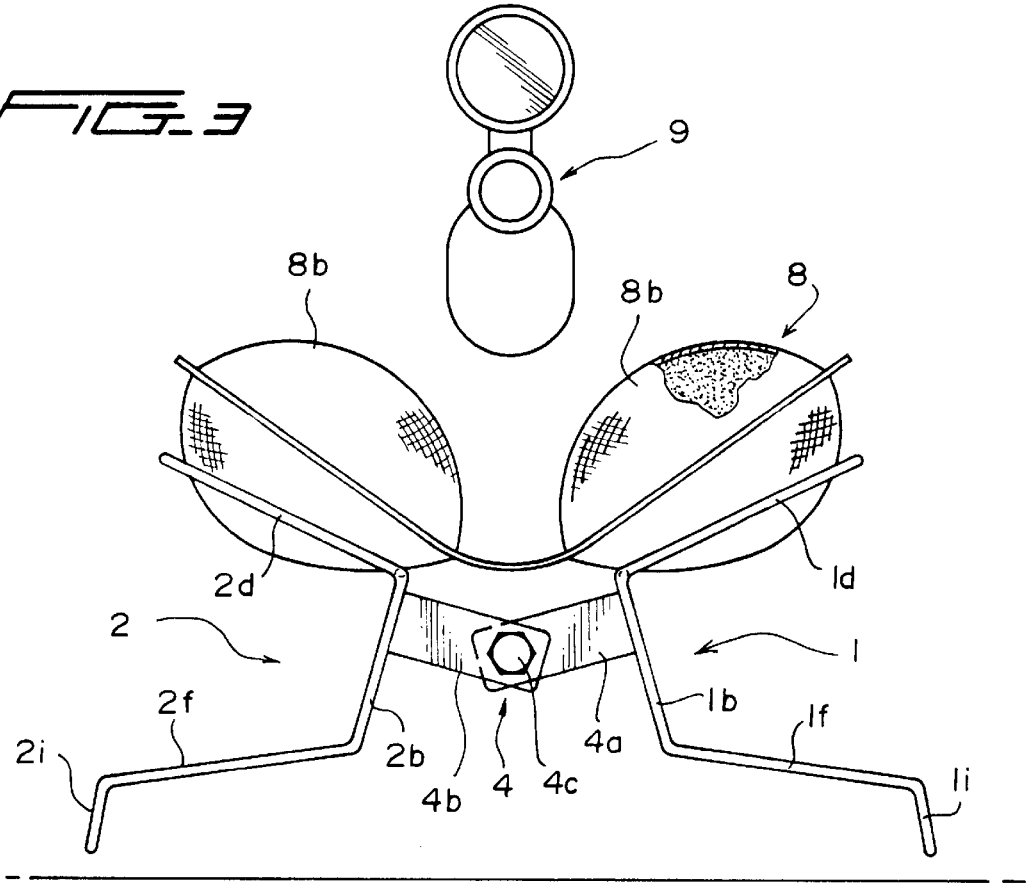
FIG. 3 is an end elevational view showing the rifle rest positioned to receive a rifle.
Figure 4:
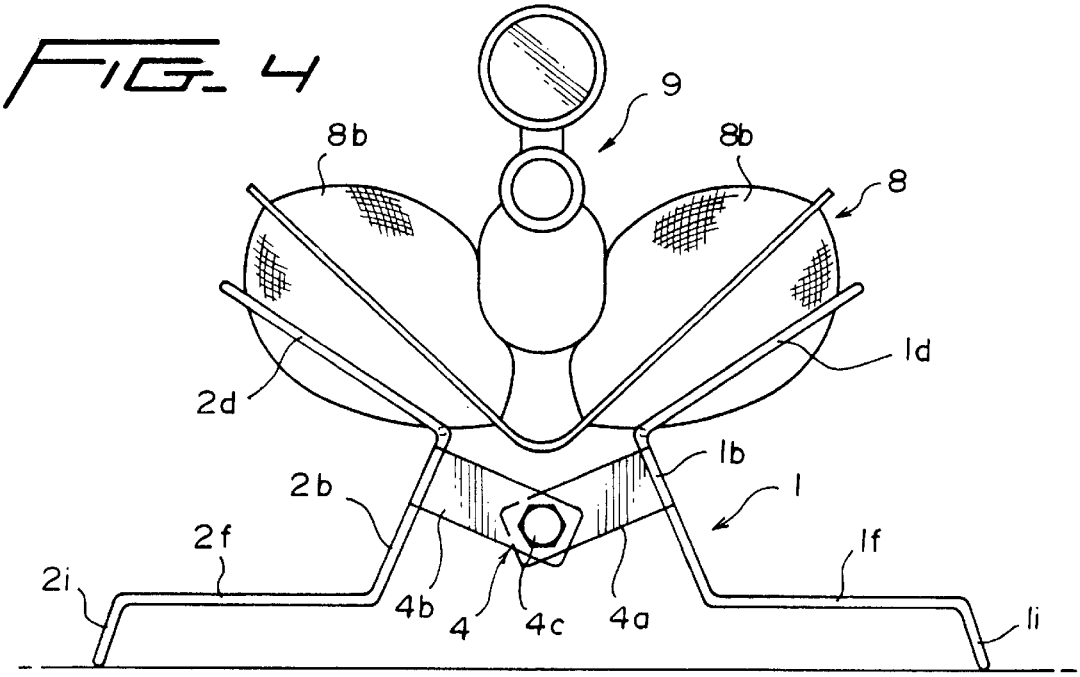
FIG. 4 is an end elevational view showing the rifle rest of FIG. 3 moved to a position to grip the rifle.

Referring to the drawings and, more particularly, to FIGS. 1 and 2, the rifle rest of the present invention comprises a pair of frame members 1 and 2 pivotally connected to each other as at 3 and 4 to provide a cradle portion 5 and a pair of support feet 6 and 7. Each frame member 1 and 2 is fabricated from a ¼-inch stainless steel rod and includes a pair of spaced parallel vertically extending medial portion 1*a*, 1*b*, 2*a*, and 2*b*. Each medial portion 1*a*, 1*b*, 2*a*, and 2*b* has a pair of integral upwardly inclined leg members 1*c*, 1*d*, 2*c*, and 2*d*, and a pair of integral downwardly inclined leg members 1*e*, 1*f*, 2*e*, and 2*f*. A pair of axially extending rods 1*g* and 2*g* are integral with the outer ends of leg members 1*c*, 1*d* and 2*c*, 2*d*, respectively, and each of the lower leg members 1*e*, 1*f*, 2*e*, and 2*f* have downwardly bent portions 1*h* and 1*i* and 2*h* and 2*i*. A pair of axially extending rods 6*a* and 7*a* are integral with the respective bent portion 1*h*, 1*i*, 2*h*, and 2*i* to form the pair of feet for the rest.

The frame members 1 and 2 are transversely spaced from each other with the. medial portions 1*a* and 1*b* of frame 1 being parallel to the medial portions 2*a* and 2*b* of frame 2. Axially extending reinforcing rods 1*j* and 2*j* extend between, and are integral with, the upper leg members 1*c* and 1*d* and 2*c* and 2*d*, respectively, in proximity to the upper end portions of the medial portions 1*a* and 1*b* and 2*a* and 2*b*.

The pivotal connections 3 and 4 are positioned in the space between the frame members 1 and 2 and comprise a pair of transverse plate members 3*a*, 4*a* having one end integral with a respective medial portion 1*a* and 1*b* and a pair of transverse plate members 3*b* and 4*b*, integral with a respective medial portion 2*a* and 2*b*. The opposite ends of the plates 3*a* and 3*b* and 4*a* and 4*b* are in overlapping relationship and are pivotally connected by a pivot pin, such as a nut and bolt assembly 3*c* and 4*c*.

The upper leg members 1*c*, 1*d* and 2*c*, 2*d*, and their respective axially extending rods 1*g* and 2*g* form the cradle 5 for supporting a sand filled bag 8 stitched as at 8*a* along its center line to form a pair of lobes 8*b* hingedly connected along the stitch line 1*a*.

By this construction and arrangement, when the feet 6 and 7 are moved outwardly, the cradle 5 is moved inwardly towards a closing position causing the lobes 8*b* to move in a direction toward each other to thereby grip the stock and barrel of a rifle 9 resting on the sand bag.

To complete the structural description of the rifle rest of the present invention, rubber tubes 10 and 11 surround the lower axially extending rods 6*a* and 7*a* to thereby provide the feet 6 and 7 with a friction surface to facilitate holding the rest on a supporting surface; the upper axially extending rods 1*g* and 2*g* are provided with strap handles 12 and 13 to facilitate carrying the rifle rest, and the pivotal connection can be covered by suitable straps. From the above description, it will be readily appreciated by those skilled in the art, that the rifle rest of the present invention is an improvement over the rifle rest disclosed in U.S. Pat. No. 5,233,779 in that by employing a steel rod to fabricate the frame members 1 and 2 forming the cradle 5 and feet 6 and 7 of the rifle rest and by employing two sand-filled lobes 8*b*, rather than four sand-filled lobes, the weight of the rifle rest is greatly reduced without sacrificing the desired features of gripping the rifle and reducing the amount of recoil transmitted to the rifle person.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

We claim:

1. A rifle rest comprising a pair of frame members, means for pivotally connecting said pair of frame members to each other to provide a cradle portion adapted to be moved to an open position and to a closed position and a pair of support feet adapted to be positioned on a supporting surface, a bag having a center line, means for fastening said bag along said center line to form a pair of lobes hingedly connected to said center line, particulate material filling said lobes, said particulate filled lobes positioned on said cradle portion and adapted to grip a rifle, whereby when the pair of support feet are pivoted in a direction toward each other, the cradle portion moves in an opening position to thereby provide a space to accommodate the stock and barrel of a rifle between said lobes, and when the pair of support feet are pivoted in a direction away from each other, the cradle moves to a closing position so that the lobes move toward each other to thereby grip the stock and barrel of the rifle.

2. A rifle rest according to claim 1, wherein each frame member comprises a pair of axially spaced vertically extending medial portions, a pair of axially spaced upwardly inclined leg members integral with one end of a respective medial portion, forming one-half of said cradle portion, a pair of axially spaced downwardly curved leg member integral with a respective another end of said medial portion to form one of said pair of support feet.

3. A rifle rest according to claim 2, wherein the medial portions of said frame members are parallel and transversely spaced from each other, the means for pivotally connecting said pair of frame members to each other comprising a transverse plate member having one end integral with a respective medial portion and extending transversely in the space between said medial portions, the opposite ends of said plates being in overlapping relationship, and a pivotal pin extending through said overlapped portion of said plates, whereby the frame members are pivotally connected to each other so that the upwardly inclined leg members form the cradle portion and the downwardly inclined leg members form the pair of support feet.

4. A rifle rest according to claim 2, wherein the lower end of each downwardly inclined leg member is provided with a downwardly bent portion, an axially extending rod being integral with, and extending between, the lower ends of said downwardly bent portions.

5. A rifle rest according to claim 2, wherein a friction surface is connected to said axially extending rod.

6. A rifle rest according to claim 2, wherein an axially extending rod extends between the upper ends of said upwardly extending leg members and a handle connected to said rod to facilitate carrying the rifle rest.

7. A rifle rest according to claim 3, wherein a cover is mounted on said transverse plate member enclosing said pivot pin.

8. A rifle rest according to claim 1 wherein said pair of frame members are fabricated from steel rod.

* * * * *